US005863250A

United States Patent [19]

Harris

[11] Patent Number: 5,863,250

[45] Date of Patent: Jan. 26, 1999

[54] AERIAL TOY

[76] Inventor: Robert Dean Harris, 2014 Bennett Ave., Chattanooga, Tenn. 37404

[21] Appl. No.: 963,667

[22] Filed: Nov. 3, 1997

Related U.S. Application Data

[63] Continuation-in-part of Ser. No. 707,001, Sep. 3, 1996, Pat. No. 5,690,533.

[51] Int. Cl.[6] ..... A63H 27/00

[52] U.S. Cl. ..... 463/34; 446/45; 473/569

[58] Field of Search ..... 473/579, 580, 473/569, 575, 576; 446/34–36, 45

[56] References Cited

U.S. PATENT DOCUMENTS

| | | | |
|---|---|---|---|
| D. 263,247 | 3/1982 | Harris | D21/82 |
| 2,899,773 | 8/1959 | Lockwood | 46/74 |
| 2,921,404 | 1/1960 | Lescher | 46/74 |
| 3,399,487 | 9/1968 | Siegler | 46/75 |
| 3,665,641 | 5/1972 | Henderson | 46/81 |
| 3,691,674 | 9/1972 | Thompson | 46/74 |
| 3,947,993 | 4/1976 | Hoppe | 46/74 |
| 5,013,277 | 5/1991 | Hufeld | 446/34 |
| 5,284,454 | 2/1994 | Randolph | 446/45 |
| 5,403,221 | 4/1995 | Savage | 446/45 |
| 5,690,533 | 11/1997 | Harris et al. | 473/569 |

FOREIGN PATENT DOCUMENTS

| | | | |
|---|---|---|---|
| 1572692 | 7/1980 | United Kingdom | 273/428 |

*Primary Examiner*—Mark S. Graham
*Attorney, Agent, or Firm*—Chambliss, Bahner & Stophel, P.C.

[57] ABSTRACT

An aerial toy is disclosed that is adapted to be launched into the air using an elastomeric band. The toy includes a nose portion that is generally in the shape of an elongate ellipsoid that has a front end and a rear end. An elongate rib depends from the rear end of the nose portion in a direction generally along the long axis of the nose portion. This rib has a first end adjacent to the nose portion and a second end. The aerial toy also includes a pair of generally planar wing portions which are arranged so that the plane of the first wing portion is generally parallel to and spaced apart from the plane of the second wing portion. The first wing portion depends from the rear end of the nose portion and from the rib, and has a tapered outer edge. The second wing portion depends from the rib and has a surface area approximately 20–80% as large as the surface area of the first wing portion.

13 Claims, 4 Drawing Sheets

AERIAL TOY

CROSS REFERENCE TO RELATED APPLICATIONS

This application is a continuation-in-part of the application entitled "Airfoil", which was filed on Sep. 3, 1996 and assigned Ser. No. 08/707,001, U.S. Pat. No. 5,690,533, the disclosure of which is fully incorporated herein by reference.

FIELD OF THE INVENTION

The invention relates to an aerial toy that is adapted to be launched into the air, preferably by means of a launcher using an elastomeric band. More particularly, the invention relates to an aerial toy that is adapted to simulate the spinning motion of a maple seed pod during the descent stage of its flight.

BACKGROUND OF THE INVENTION

Aerial toys that are adapted to be launched or catapulted into the air generally have been of one of two types. Some such toys are adapted to glide down from their maximum altitude, while others are adapted to descend in some type of spinning motion. Each type has its peculiar characteristics and deficiencies. The gliding toys are not generally intended to be launched or catapulted to a high altitude, because their flight characteristics will dictate a descent that is unpredictable or that takes them far away from the launch point. On the other hand, spin flight toys are generally difficult to launch to a high altitude, because the characteristics that permit a spinning descent will generally interfere with a launch to a high altitude. In addition, the mass of the toy, especially a spin flight toy, will have a significant effect on its flight characteristics. Generally, the ascending flight of a more massive toy will be easier to control than that of a less massive toy. However, the heavier toy will also tend to descend more rapidly than a lighter toy. Various techniques have been employed in attempts to take advantage of favorable flight characteristics, while addressing these and other physical deficiencies.

One type of spinning toy is designed to have descending flight characteristics that are similar to that of a helicopter. Examples of such toys are described in U.S. Pat. No. 3,399,487 of Siegler and U.S. Pat. No. 5,284,454 of Randolph. Each of these toys is provided with a generally planar body portion having a pair of folding wings that are adapted for unfolding from a closed position that is in alignment with the body portion to an open position that is perpendicular thereto. Each such toy is adapted to be launched vertically in a folded configuration using an elastomeric band. After launch and as the toy begins to fall, however, the wings unfold to the perpendicular configuration and the toy spins down in the manner of a helicopter.

Other types of spinning toys are designed to spin about any of several axes defined by their structural configurations. Thus, for example, U.S. Pat. No. 5,403,221 of Savage describes a flat, thin, lightweight toy that is adapted for being launched vertically using an elastomeric band. This toy has a flat elliptical-shaped head portion and a flat depending tail portion which together resemble an oval intersecting a triangle. The Savage toy is comprised of a planar, rigid material such as expanded or extruded polystyrene that is overlain with a flexible, protective outer surface member such as polypropylene packaging tape. The outer surface member overlaps the underlying rigid member so as to form an aerodynamic edge around the periphery of the rigid member. Because the Savage toy has a height greater than its width and a surface area of the head that is greater than that of the tail, it will spin, upon being launched vertically, in a flat plane about its shortest axis, and it will descend in a spiral path, accompanied by a spin about its longest axis. The Savage toy is of fairly simple construction, but it is intended to be constructed of very lightweight materials. Therefore, it may be quite fragile and not as durable as desired. In addition, since the Savage toy is designed to rotate about the short axis of its flat surface upon launch, it seems unlikely that it could attain a high altitude. Finally, the rotation about the short axis of this toy during the ascent stage of its flight presents a large surface area to any wind that may be present. This coupled with its low weight would seem to preclude ready control of its launch path.

U.S. Pat. No. 3,665,641 of Henderson describes a toy that may be more durable than the Savage toy. The Henderson toy is generally shaped like a tear-drop, having a flat upper side and a substantially flat lower side. The rear end of the toy is rounded and the side edges are diagonally tapered to a point at the front end. The lower side is provided with a rearwardly bent hook at the front end and an arcuate bulge that extends from behind the hook to approximately the longitudinal center of the body. The rear portion of the lower side of the toy is flat like the upper side. The toy of Henderson ascends upon launch in a flat plane, but as it descends, it travels in a helical path while spinning about its long axis. The Henderson toy is a rigid toy, preferably made of aluminum, wood or plastic. Such a toy might pose a danger of injury to a bystander, if it is launched in his direction.

U.S. Pat. No. 3,947,993 of Hoppe describes a flying toy in the form of an airfoil having an extremely complicated surface architecture. This toy comprises an elongated body having a nose portion, a mid-section and a trailing edge portion, and it includes a plurality of curved surfaces which vary more-or-less constantly in configuration from the nose portion rearwardly along the full longitudinal length of the elongated body. Certain of these surfaces promote spinning of the toy about its long axis during both its ascending and its descending flight, while other surfaces cooperate to spin the toy, as it descends, about its center of gravity along a second axis which traverses the long axis.

U.S. Pat. No. 5,013,277 of Hufeld describes an aerial toy having a spine with a counterweight at the front end. Attached to the spine is a flat wing in the general shape of an isosceles triangle having a rounded end opposite the front end of the spine. The toy also includes a pair of small stabilizer fins that are located in a common plane on either side of the spine at the end away from the front end, and a flap on the wing opposite the stabilizer fins. The toy of Hufeld is adapted to be launched vertically upwardly by a rubberband-type launcher, and as it descends, it apparently spins about the axis of the spine as well as about a vertical axis through its center of mass. The Hufeld toy is of a somewhat complicated design, being comprised of several different components that must be assembled together.

Several aerial toys are designed to simulate the appearance and/or the descending flight characteristics of a maple seed pod, which spins in a generally flat plane about a vertical axis through its center of mass as it descends. Among these are toys that are designed to be thrown, such as the aerial toy described in U.S. Pat. No. 5,173,069 of Litos et al. or the toy shown in U.S. Pat. No. D338,245 of Litos. Because these toys are thrown into the air, they are unlikely to reach a high altitude. Other toys of similar design are intended to be launched with an elastomeric launcher, including those shown in U.S. Pat. No. D263,247 of Harris and in U.S. Pat. No. D121,924 of Kerezi, and the toy described and claimed in U.S. Pat. No. 3,353,295 of Downey. The Downey toy includes a square bulbous nose and a wing having a substantially straight leading edge, a curved tip and a trailing edge that is curved so as to give the wing a generally triangular shape. Upon launch, the Downey toy will climb like an arrow or bullet to a high altitude, where it will assume a horizontal attitude and begin to spin about a vertical axis through its center of mass. Because of the relatively large bulbous nose of the Downey toy, it seems unlikely that it may be launched to as high an altitude as a more streamlined toy.

All of these toys have certain undesirable characteristics, and it would be desirable if a toy could be developed that would overcome these and other failings of previously known toys.

OBJECTS AND ADVANTAGES OF THE INVENTION

Accordingly, it is an object of the invention claimed herein to provide an airfoil or an aerial toy that is capable of being launched into the air using an elastomeric band, and which is capable of reaching a relatively high altitude in a controlled flight. It is another object of the invention to provide such a toy that will descend from its maximum altitude at a relatively slow rate and in a predictable fashion. It is yet another object of the invention to provide such a toy that will exhibit interesting and amusing flight characteristics both in the ascending and the descending stages of its flight. Another object of this invention is to provide such a toy that will simulate the spinning motion of a maple seed pod during the descent stage of its flight. It is yet another object of this invention to provide such a toy that is of a relatively simple design that may be manufactured economically. A further object of this invention is to provide such a toy that can be made from flexible plastic materials that will reduce the risk of injury to a bystander if the toy is mishandled or misused.

Additional objects and advantages of this invention will become apparent from an examination of the drawings and the ensuing description.

SUMMARY OF THE INVENTION

Accordingly, the invention comprises an aerial toy that is adapted to be launched into the air using an elastomeric band. The aerial toy includes a nose portion that is generally in the shape of an elongate ellipsoid, said nose portion having a front end and a rear end. The aerial toy also includes an elongate rib depending from the rear end of the nose portion in a direction generally along the long axis of said nose portion, said rib having a first end adjacent to the nose portion and a second end. The aerial toy also includes a pair of generally planar wing portions which are arranged so that the plane of the first wing portion is generally parallel to and spaced apart from the plane of the second wing portion. The first wing portion depends from the rear end of the nose portion and from the rib, and has a tapered outer edge. The second wing portion depends from the rib and has a surface area approximately 20–80% as large as the surface area of the first wing portion.

In order to facilitate an understanding of the invention, the preferred embodiment of the invention is illustrated in the drawings, and a detailed description thereof follows. It is not intended, however, that the invention be limited to the particular embodiment described or to use in connection with the particular apparatus illustrated herein. Various changes are contemplated such as would ordinarily occur to one skilled in the art to which the invention relates.

DESCRIPTION OF THE PREFERRED EMBODIMENTS

In copending application Ser. No. 08/707,001, an airfoil or aerial toy that is adapted for being launched using an elastomeric band is described. This device includes a nose portion that is generally in the shape of an elongate ellipsoid, said nose portion having a front end and a rear end. An elongate rib depends from the rear end of the nose portion in a direction generally along the long axis of the nose portion, and a pair of generally planar wing portions depend from the rear end of the nose portion and from the rib. Each wing portion has a tapered outer edge, and the plane of the first wing portion is generally parallel to and spaced apart from the plane of the second wing portion. Furthermore, the taper of the outer edge of the first wing portion is oppositely disposed to that of the second wing portion. The preferred embodiment of this device exhibits a single action spin in its ascent stage and a dual action spin in its descent stage. This embodiment will rotate about an axis defined by its rib as it ascends after launch to its maximum altitude. Upon reaching its maximum altitude, the preferred airfoil will stall and will assume a slightly nose-down attitude, of about 20° with respect to the horizontal, as it descends. Furthermore, it will rotate about an axis defined by its rib as well as about an axis passing through its center of mass and generally through the center of mass of the Earth as it descends from its maximum altitude.

It has now been discovered that by modifying the preferred embodiment of this device, an entirely new and different set of flight characteristics may be produced.

Figure 1:
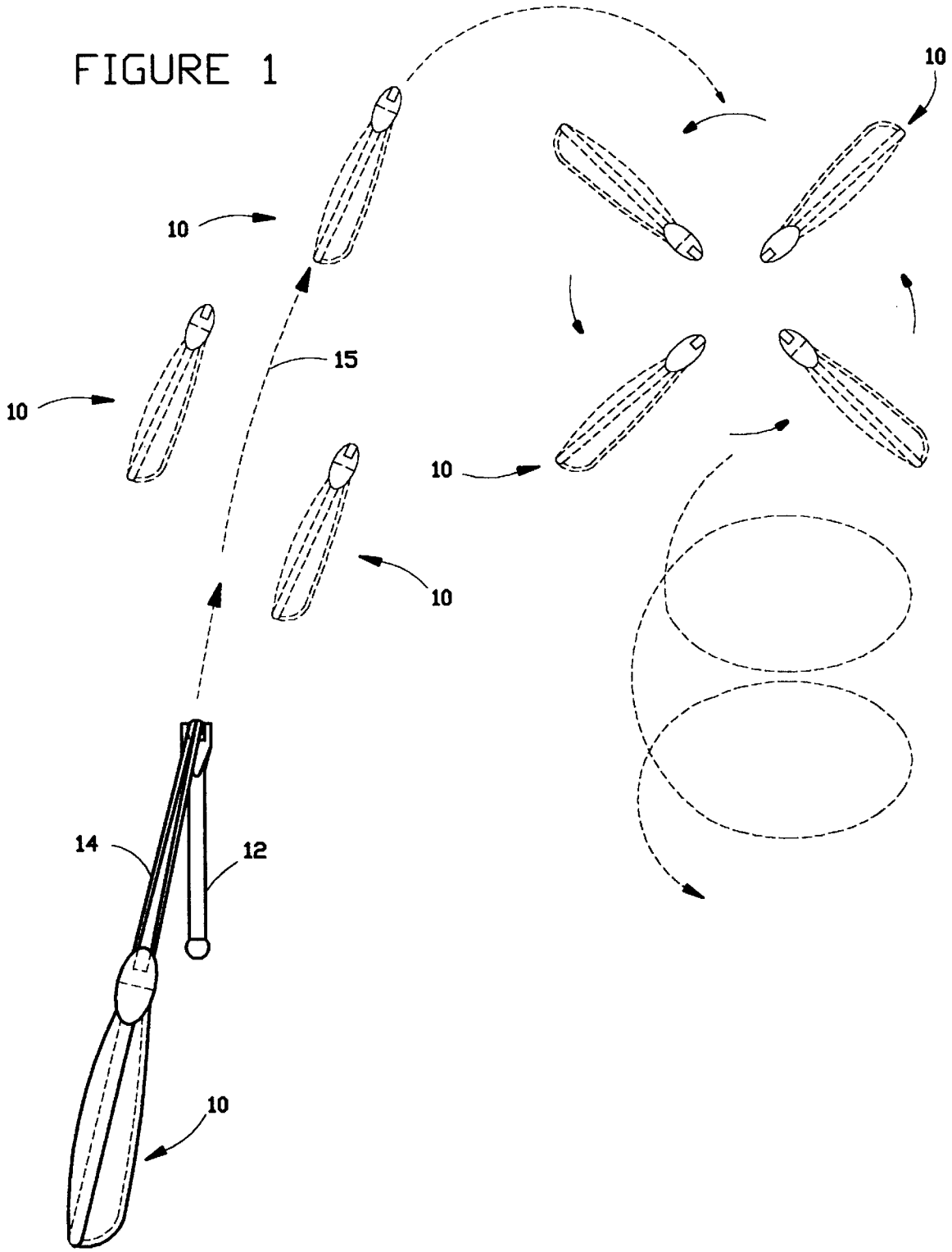
FIG. 1 illustrates a preferred means of launch of the preferred embodiment of the invention, as well as its ascending and descending flight characteristics.

Referring now to the drawings, FIG. 1 illustrates a preferred method of launch of a preferred embodiment 10 of the invention using stick-launcher 12 employing elastomeric band 14. This launcher is of the type that is comprised of a stick-like structure 12 with an elastomeric band 14 affixed at one end so as to form a loop. It is adapted to be held in one hand by a user while the other hand is used to pull the aerial toy back against the tension of the elastomeric band. Of course, other types of launchers may be used, such as the slingshot type that is illustrated in U.S. Pat. No. 3,665,641 of Henderson. Aerial toy 10 may also be launched by mechanical means such a spring-loaded launcher, or it may be launched by dropping it from an aircraft, or by any other suitable means now known or subsequently developed. The aerial toy may also be launched by throwing it into the air, although generally greater altitudes, and hence longer flight times, may be obtained when the aerial toy is launched from the ground using an elastomeric band. Preferably, the toy will be launched vertically or nearly so, and in such case and depending upon wind conditions, its flight will not typically carry it an inconvenient distance for retrieval from the launcher.

Figure 2:
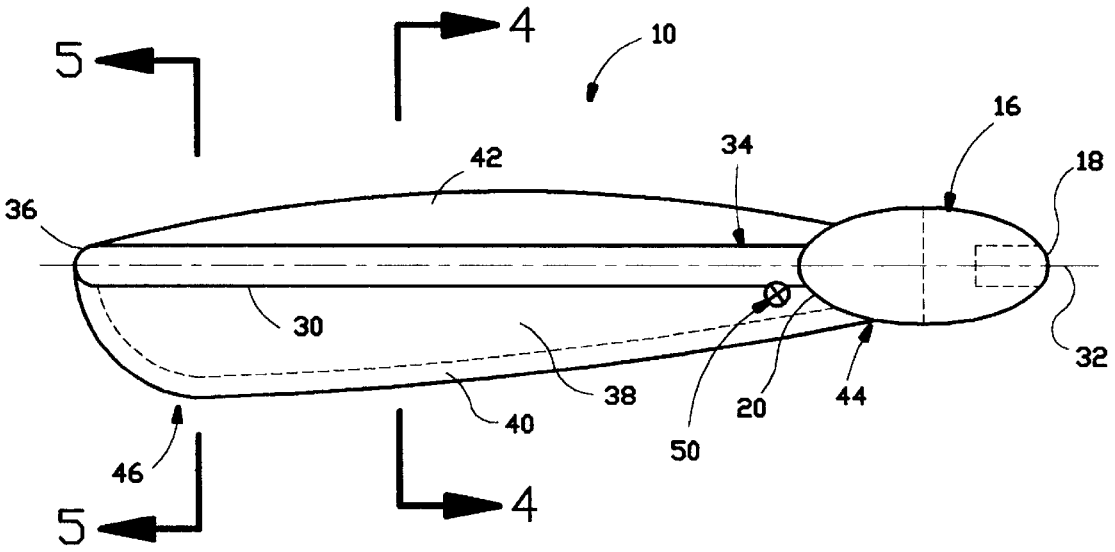
FIG. 2 is a plan view of the embodiment of the invention illustrated in FIG. 1.
Figure 3:
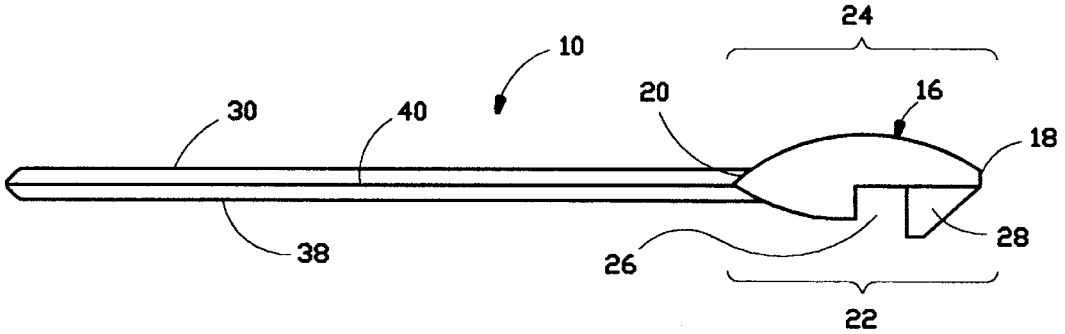
FIG. 3 is a side view of the aerial toy of FIG. 2.

Referring now to FIGS. 2 through 5, it can be seen that the preferred embodiment 10 of the invention includes nose portion 16 that is generally in the shape of an elongate ellipsoid, with a curved or rounded front end 18 and a similarly curved or rounded rear end 20. Furthermore, as shown in FIG. 3, nose portion 16 has a first side 22, which may be considered to be the lower side, and a second side 24, which may be considered to be the upper side. Preferably, the nose portion has a notch 26 across the short axis of the first side near the front end, and an appendage 28 adjacent to said notch, which notch and appendage are adapted for receiving the elastomeric band of a launcher.

Figure 4:
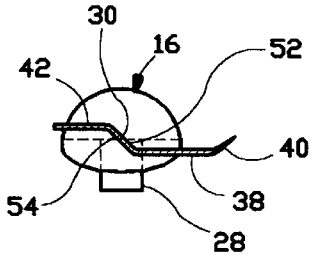
FIG. 4 is a sectional view of the aerial toy of FIG. 2, taken along the lines 4—4 of FIG. 2.
Figure 5:
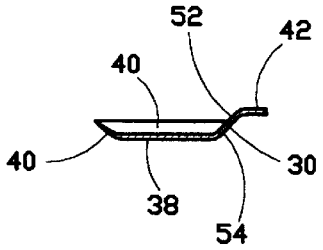
FIG. 5 is a sectional view of the aerial toy of FIG. 2, taken along the lines 5—5 of FIG. 2.

Aerial toy 10 also includes an elongate rib 30 that depends from the rear end 20 of nose portion 16 in a direction generally along the long axis of said nose portion (which is identified by centerline 32 in FIG. 2). Rib 30 has a first end 34 adjacent to rear end 20 of nose portion 16, and a second end 36. Aerial toy 10 also includes a first generally planar wing portion 38 and a second generally planar wing portion 42. As shown in FIG. 2, first wing portion 38 depends from the rear end 20 of nose portion 16, and also from rib 30. First wing portion 38 also has a tapered outer edge 40, the taper of which is best shown in FIGS. 4 and 5.

It is preferred that the outer edge of the first wing portion is tapered along at least about 20% of its length, and in such case, the outer edge of the first wing portion is preferably tapered from a point where it joins the second end of the rib along the periphery thereof in a direction towards the nose portion. However, the outer edge of the first wing portion may also be tapered along a greater length, and even substantially its entire length, as shown in FIG. 2. Thus tapered outer edge 40 of first wing portion 38 of toy 10 extends from the rear end 20 of nose portion 16, where wing portion 38 attaches thereto, all the way around the outer periphery of wing portion 38 to end 36 of rib 30. Preferably, as shown in FIG. 2, wing portion 38 is of increasing width from a first point 44 adjacent to the rear end 20 of nose portion 16 to a second point 46 near second end 36 of rib 30.

Aerial toy 10 also includes a second generally planar wing portion 42 that depends from rib 30.

Preferably as shown in FIG. 2, the second wing portion will also depend from the rear end of the nose portion. The second wing portion has a surface area approximately 20–80%, and preferably 20–50%, as large as the surface area of first wing portion 38. Furthermore, as best shown in FIGS. 4 and 5, the plane of first generally planar wing portion 38 is generally parallel to and spaced apart from the plane of second generally planar wing portion 42.

Preferably, rib 30 provides a pair of angled substantially planar transitions or transition segments 52 and 54 (see FIGS. 4 and 5) from the first wing portion to the second wing portion. It is believed that preferred results may be obtained when these transition segments are parallel and are disposed at an angle within the range of about 30° to about 60°, and more preferably about 45°, between the plane of the first wing portion and the plane of the second wing portion.

When launched using an elastomeric band, toy 10 is capable of attaining an altitude of up to one hundred feet or more, and its total flight may last for more than a minute. As FIG. 1 shows, the preferred embodiment of the invention will maintain a relatively constant attitude in its ascent stage, except that it travels in a corkscrew-shaped path about an ascent axis 15 defined by the launch trajectory. Upon reaching its maximum altitude, the aerial toy will stall and will assume a nearly horizontal attitude as it descends. Furthermore, it will rotate in the manner of a maple seed pod about a vertical axis passing through its center of mass and generally through the center of mass of the Earth as it descends from its maximum altitude. It is believed that this spinning action is obtained because the configuration of the toy causes it to rotate in a counterclockwise direction (when viewed from above) with second wing portion 42 acting as a leading edge in the direction of spin in a slightly higher plane than that of first wing portion 38.

The center of mass of the preferred embodiment illustrated in the drawings is located near the junction of the rib and the nose portion. As shown in FIG. 2, the approximate location of the center of mass of aerial toy 10 is at point 50. Because the center of mass of the toy is preferably located near the junction of the rib and the nose portion, at least about 30% of the total mass of the preferred embodiment of the toy will be in the nose portion.

Good results have been obtained when the aerial toy 10 is provided in a total length of about 5.75 inches and with a width of the first wing portion (at widest point 46) of about 0.6875 inches. However, smaller or larger versions of the aerial toy may also be provided. Preferably, the aerial toy is manufactured from a flexible, plastic material by injection molding or blow molding. Good results have been obtained when the toy is made from polyethylene or polypropylene, although the toy may also be made by a foam injection molding process from urethane foam or styrene foam that is coated with a resin or other material to enhance its strength. It may be provided in any color, including fluorescent and phosphorescent colors. It may also be provided with decals or other forms of surface ornamentation. It may even be equipped with one or more small electric lights powered by a small battery in the nose portion.

Preferably, the toy is made by injection molding from polyethylene in the dimensions recited above. Such a toy will preferably have a total weight of about four to seven grams. The nose portion will therefore have a weight of preferably at least about 1.2–2.1 grams.

Figure 6:
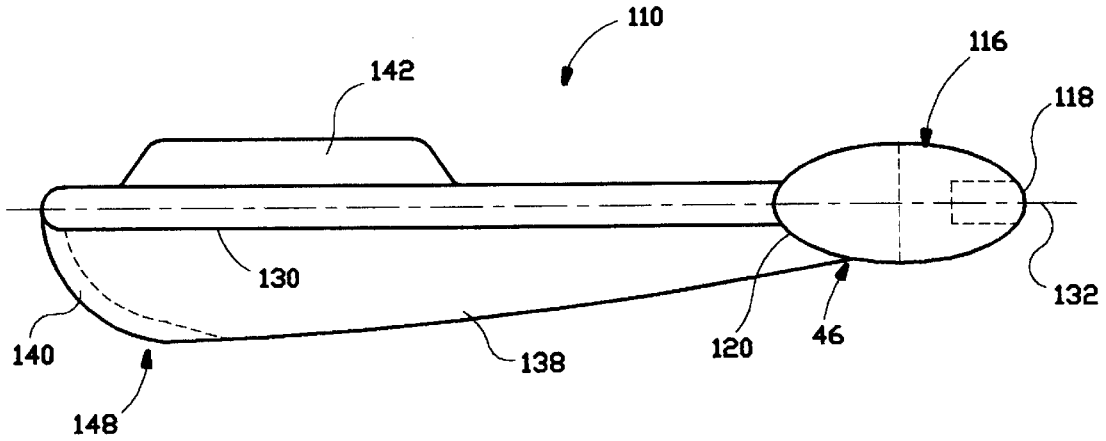
FIG. 6 is a plan view of a second embodiment of the invention.
Figure 7:
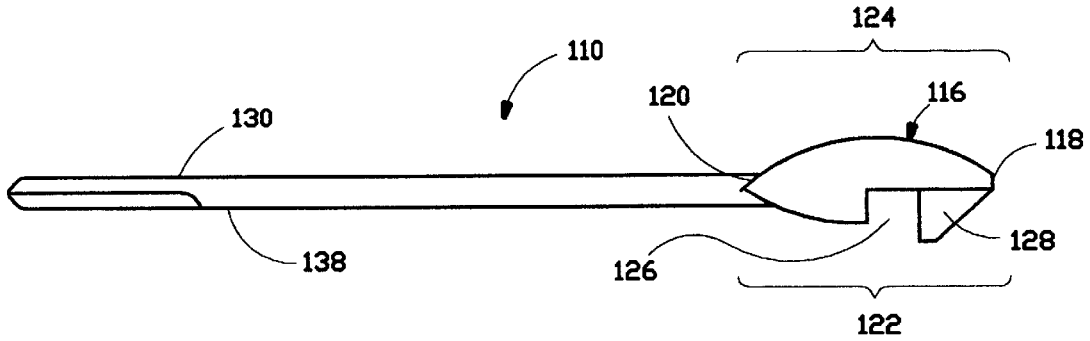
FIG. 7 is a side view of the second embodiment illustrated in FIG. 6.

Referring now to FIGS. 6 and 7, a second embodiment 110 of the invention is illustrated. Aerial toy 110 includes nose portion 116 that is generally in the shape of an elongate ellipsoid, with a curved or rounded front end 118 and a similarly curved or rounded rear end 120. As shown in FIG. 7, the nose portion 116 of toy 110 has a first side 122, which may be considered to be the lower side, and a second side 124, which may be considered to be the upper side. Preferably, the nose portion has a notch 126 across the short axis of the first side near the front end, and an appendage 128 adjacent to said notch, which notch and appendage are adapted for receiving the elastomeric band of a launcher.

Aerial toy 110 also includes an elongate rib 130 that depends from the rear end 120 of nose portion 116 in a direction generally along the long axis of said nose portion (which is identified by centerline 132 in FIG. 6). Rib 130 has a first end 134 adjacent to rear end 120 of nose portion 116, and a second end 136. Aerial toy 110 also includes a first generally planar wing portion 138 and a second generally planar wing portion 142. As shown in FIG. 6, first wing portion 138 depends from the rear end 120 of nose portion 116, and also from rib 130. First wing portion 138 also has a tapered outer edge 140. As shown in FIGS. 6 and 7, outer edge 140 of first wing portion 138 is tapered along at least about 20% of its length. Preferably outer edge 140 is tapered from a point where it joins second end 136 of rib 130 along the periphery of wing portion 138 in a direction towards the nose portion. In addition, as shown in FIG. 6, wing portion 138 is of increasing width from a first point 144 adjacent to the rear end 120 of nose portion 116 to a second point 146 near second end 136 of rib 130, as is preferred.

Aerial toy 110 also includes a second generally planar wing portion 142 that depends from rib 130. This second wing portion has a surface area approximately 20–80%, and preferably 20–50%, as large as the surface area of first wing portion 138. Furthermore, although not shown in the drawings, the plane of first generally planar wing portion 138 is generally parallel to and spaced apart from the plane of second generally planar wing portion 142, similar to the arrangement of wing portions in aerial toy 10 of FIGS. 1 through 5.

The flight characteristics of aerial toy 110 will be similar in all respects to those of aerial toy 10 illustrated in FIG. 1. When launched using an elastomeric band, toy 110 will maintain a relatively constant attitude in its ascent stage, except that it travels in a corkscrew-shaped path about an ascent axis defined by the launch trajectory. Upon reaching its maximum altitude, the aerial toy will stall and will assume a nearly horizontal attitude as it descends. Furthermore, it will rotate in the manner of a maple seed pod about a vertical axis passing through its center of mass and generally through the center of mass of the Earth.

Figure 8:
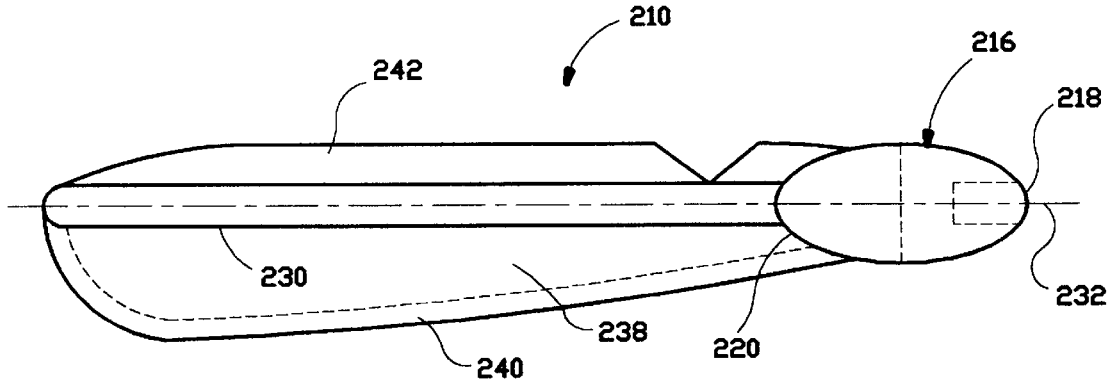
FIG. 8 is a plan view of a third embodiment of the invention.
Figure 9:
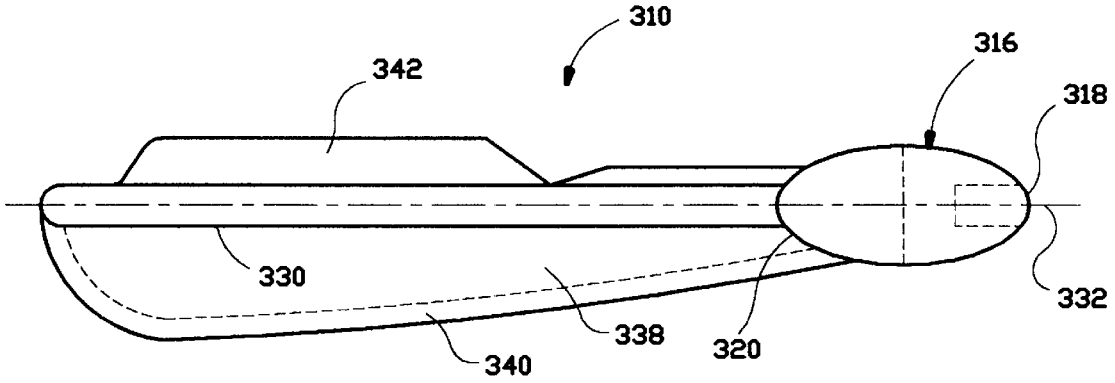
FIG. 9 is a plan view of a fourth embodiment of the invention.
Figure 10:
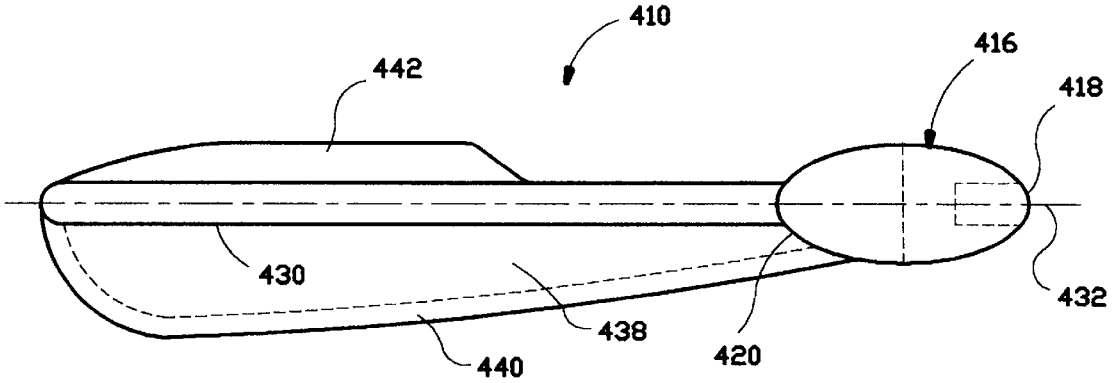
FIG. 10 is a plan view of a fifth embodiment of the invention.

FIGS. 8, 9 and 10 illustrate third, fourth and fifth embodiments 210, 310 and 410, respectively, of the invention. These aerial toys are similar to the embodiments illustrated in FIGS. 1 through 6 and are illustrative of some of the variations in the second wing portion that are contemplated within the scope of the invention. Aerial toys 210, 310 and 410 include, respectively, nose portions 216, 316 and 416 that are generally in the shape of an elongate ellipsoid, with a curved or rounded front end and a similarly curved or rounded rear end.

Preferrably the nose portions have a notch across the short axis of a first side of the nose portion near the front end, and an appendage adjacent to said notch, which notch and appendage are adapted for receiving the elastomeric band of a launcher.

Aerial toys 210, 310 and 410 also include elongate ribs 230, 330 and 430 that depend from the rear end of the nose portion in a direction generally along the long axis of said nose portion (which is identified by centerlines 232, 332 and 432 respectively in FIGS. 8, 9 and 10). The rib has a first end adjacent to the rear end of the nose portion, and a second end located away from the nose portion. Each of toys 210, 310 and 410 also includes a first generally planar wing portion 238, 338 and 438, which depends from the rear end of the nose portion and also from the rib. The first wing portion also has a tapered outer edge. Preferably, the outer edge of the first wing portion is tapered along at least about 20% of its length, and most preferably along its entire length.

Each of aerial toys 210, 310 and 410 also includes a second generally planar wing portion 242, 342 and 442 that depends from the rib. This second wing portion has a surface area approximately 20–80%, and preferably 20–50%, as large as the surface area of the first wing portion. Furthermore, although not shown in the drawings, the plane of the first generally planar wing portion is generally parallel to and spaced apart from the plane of the second generally planar wing portion, similar to the arrangement of wing portions in aerial toy 10 of FIGS. 1 through 5 and aerial toy 110 of FIGS. 6 and 7.

The flight characteristics of aerial toys 210, 310 and 410 will be similar in all respects to those of aerial toy 10 illustrated in FIG. 1. When launched using an elastomeric band, these toys will maintain a relatively constant attitude in their ascent stage, except that they will travel in a corkscrew-shaped path about an ascent axis defined by the launch trajectory. Upon reaching their maximum altitude, these aerial toys will stall and assume a nearly horizontal attitude as they descend. Furthermore, they will rotate in the manner of a maple seed pod about a vertical axis passing through their center of mass and generally through the center of mass of the Earth.

All of the embodiments of the invention illustrated in the drawings show the first wing portion on the right side of the toy, when the toy is arranged with its nose portion at the top. In FIG. 1, toy 10 having larger wing portion 38 on the right side is illustrated as assuming a descent attitude with notch 26 oriented downwardly. The invention may also be provided with the larger first wing portion on the left side. In such case, the toy will assume a descent attitude with the notch of its nose portion oriented upwardly, and will otherwise descend in the same manner as the illustrated embodiments, in a counterclockwise spin with the smaller wing portion leading in the direction of spin.

Although this description contains many specifics, these should not be construed as limiting the scope of the invention but as merely providing illustrations of some of the presently preferred embodiments thereof, as well as the best mode contemplated by the inventor of carrying out the invention. The invention, as described herein, is susceptible to various modifications and adaptations, and the same are intended to be comprehended within the meaning and range of equivalents of the appended claims.

What is claimed is:

1. An aerial toy that is adapted to be launched into the air using an elastomeric band, said toy including:

(a) a nose portion that is generally in the shape of an elongate ellipsoid, said nose portion having a front end and a rear end;

(b) an elongate rib depending from the rear end of the nose portion in a direction generally along the long axis of said nose portion, said rib having a first end adjacent to the nose portion, and a second end;

(c) a first generally planar wing portion that:

(i) depends from the rear end of the nose portion;

(ii) depends from the rib;

(iii) has a tapered outer edge; and (d) a second generally planar wing portion that:

(i) depends from the rib; and (ii) has a surface area approximately 20–80% as large as the surface area of the first wing portion;

wherein the plane of the first wing portion is generally parallel to and spaced apart from the plane of the second wing portion.

2. The aerial toy of claim 1, wherein the second wing portion has a surface area approximately 20–50% as large as the surface area of the first wing portion.

3. The aerial toy of claim 1, wherein the second wing portion depends from the rear end of the nose portion.

4. The aerial toy of claim 1, wherein the nose portion has a first side and a second side, a notch across the short axis of the first side near the front end, and an appendage adjacent to said notch, and wherein the notch and the appendage are adapted for receiving the elastomeric band of a launcher.

5. The aerial toy of claim 1, wherein the first wing portion is of increasing width from a first point adjacent to the nose portion to a second point near the second end of the rib.

6. The aerial toy of claim 1, which is adapted to rotate about an axis passing through its center of mass and generally through the center of mass of the Earth as it descends from its maximum altitude.

7. The aerial toy of claim 1, which is made from a material selected from the group consisting of polyethylene, polypropylene, urethane foam and styrene foam.

8. The aerial toy of claim 1, wherein the outer edge of the first wing portion is tapered along at least about 20% of its length.

9. The aerial toy of claim 8, wherein the outer edge of the first wing portion is tapered from a point where it joins the second end of the rib along the periphery thereof in a direction towards the nose portion.

10. The aerial toy of claim 1, wherein the rib provides a pair of angled substantially planar transitions from the first wing portion to the second wing portion.

11. The aerial toy of claim 10, wherein the transitions are parallel and are disposed at an angle within the range of about 30° to about 60° between the plane of the first wing portion and the plane of the second wing portion.

12. The aerial toy of claim 1, wherein at least about 30% of the total mass thereof is in the nose portion.

13. The aerial toy of claim 12, the center of mass of which is located near the junction of the rib and the nose portion.

* * * * *